US011519249B2

(12) United States Patent
Tanner et al.

(10) Patent No.: US 11,519,249 B2
(45) Date of Patent: Dec. 6, 2022

(54) GAS VENT FOR A SEAL SECTION OF AN ELECTRICAL SUBMERSIBLE PUMP ASSEMBLY

(71) Applicant: Baker Hughes Oilfield Operations LLC, Houston, TX (US)

(72) Inventors: David Tanner, Broken Arrow, OK (US); Aron Meyer, Pryor, OK (US); Ryan Semple, Owasso, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 311 days.

(21) Appl. No.: 16/820,983

(22) Filed: Mar. 17, 2020

(65) Prior Publication Data

US 2020/0300075 A1 Sep. 24, 2020

Related U.S. Application Data

(60) Provisional application No. 62/820,018, filed on Mar. 18, 2019.

(51) Int. Cl.

| | |
|---|---|
| ***E21B 43/14*** | (2006.01) |
| ***E21B 43/38*** | (2006.01) |
| ***F04B 47/06*** | (2006.01) |
| ***F04B 53/06*** | (2006.01) |
| ***F04B 53/18*** | (2006.01) |
| ***E21B 43/12*** | (2006.01) |

(52) U.S. Cl.

CPC ..... *E21B 43/128* (2013.01); *E21B 43/38* (2013.01); *F04B 47/06* (2013.01); *F04B 53/06* (2013.01); *F04B 53/18* (2013.01)

(58) Field of Classification Search

CPC ..... E21B 43/38; E21B 43/128; E21B 43/12; E21B 23/04; E21B 43/10; F04B 47/06; F04B 53/06; F04B 53/18

See application file for complete search history.

(56) References Cited

U.S. PATENT DOCUMENTS

| | | | |
|---|---|---|---|
| 3,610,268 | A | 10/1971 | Arutunoff |
| 6,268,672 | B1 | 7/2001 | Straub et al. |
| 6,668,925 | B2 | 12/2003 | Shaw et al. |

(Continued)

FOREIGN PATENT DOCUMENTS

WO 2017096103 A1 6/2017

OTHER PUBLICATIONS

International Search Report and Written Opinion of PCT/US2020/023212 dated Aug. 7, 2020: pp. 1-11.

*Primary Examiner* — Michael R Wills, III

(74) *Attorney, Agent, or Firm* — Bracewell LLP; Keith R. Derrington

(57) ABSTRACT

A seal section of a submersible well pump assembly has an expandable and contractible bag surrounded by a pressure equalizing chamber. A motor lubricant communication path communicates motor lubricant the bag interior. A well fluid port admits well fluid into the pressure equalizing chamber. A gas vent passage leads from the pressure equalizing chamber to the exterior of the enclosure. At least one membrane in the gas vent passage allows gas contained in the well fluid in the pressure equalizing chamber to vent. The membrane blocks liquid from flowing through the gas vent passage into and out of the pressure equalizing chamber.

18 Claims, 4 Drawing Sheets

(56) References Cited

U.S. PATENT DOCUMENTS

| | | | | |
|---|---|---|---|---|
| 7,530,391 | B2 | 5/2009 | Hall et al. | |
| 7,665,975 | B2 | 2/2010 | Parmeter et al. | |
| 9,470,216 | B2 | 10/2016 | Reeves et al. | |
| 10,371,167 | B2 * | 8/2019 | Meyer | F01M 1/10 |
| 2007/0140876 | A1 * | 6/2007 | Parmeter | F04D 13/10 417/423.11 |
| 2009/0044617 | A1 * | 2/2009 | DiFoggio | E21B 49/081 73/152.55 |
| 2016/0076550 | A1 * | 3/2016 | Collins | F04D 13/10 277/336 |
| 2016/0245042 | A1 | 8/2016 | Napier et al. | |
| 2017/0037861 | A1 * | 2/2017 | Rutter | F04D 29/102 |
| 2019/0040711 | A1 * | 2/2019 | McManus | E21B 43/128 |
| 2020/0133316 | A1 * | 4/2020 | Tanner | E21B 43/128 |

* cited by examiner

GAS VENT FOR A SEAL SECTION OF AN ELECTRICAL SUBMERSIBLE PUMP ASSEMBLY

CROSS-REFERENCE TO RELATED APPLICATION

This application claims priority to provisional application Ser. No. 62/820,018, filed Mar. 18, 2019.

FIELD OF DISCLOSURE

The present disclosure relates to electrical submersible well pump assemblies, and in particular to a seal section with a vent to expel gas that may otherwise accumulate in an upper portion of an elastomeric bag chamber.

BACKGROUND

Electrical submersible pumps (ESP) are commonly used in hydrocarbon producing wells. An ESP includes a pump driven by an electrical motor filled with a dielectric motor lubricant. A seal section connected between the motor and the pump has a shaft seal to retard the entry of well fluid into contamination with the motor lubricant. The seal section also typically has one or more pressure equalizers to reduce a pressure differential between the motor lubricant and exterior well fluid. The pressure equalizer may be an elastomeric bag or a metal bellows. If two pressure equalizers are employed, each may be in a separate pressure equalizing chamber, one above the other. Motor lubricant in communication with the motor lubricant in the motor fills each pressure equalizer. A well fluid port admits well fluid to the pressure equalizing chambers on the exteriors of the pressure equalizers, causing the motor lubricant pressure in the motor to substantially equal the hydrostatic well fluid pressure.

During operation, the temperature of the motor will elevate, which causes the motor lubricant to expand. If the pressure equalizers are full and cannot expand more, a check valve will open to expel some of the motor lubricant into the pressure equalizing chamber. When the ESP is shut down, the motor cools, reducing the volume of lubricant and causing the pressure equalizers to contract, admitting more well fluid into the pressure equalizing chambers.

The well fluid is often a mixture of oil, water and gas. In one design of a seal section having two elastomeric bags, the well fluid port is located in the lower pressure equalizing chamber. Gas in the well fluid could migrate to an upper portion of the upper pressure equalizing chamber. The gas may accumulate around and above the upper bag, possibly harming the bag and eventually permeating through the elastomeric material. The entry of gas into the dielectric motor lubricant could cause problems with the motor. Also, the accumulation of gas around the elastomeric bag and sealing elastomers can reduce their effective life by increasing the risk of rapid gas decompression events.

SUMMARY

A submersible well pump assembly comprises an enclosure with an expandable and contractible bag within the enclosure, defining a pressure equalizing chamber in the enclosure surrounding an exterior of the bag. A motor lubricant communication path communicates motor lubricant from a motor of the assembly to an interior of the bag. A well fluid port admits well fluid on an exterior of the enclosure into the pressure equalizing chamber. A gas vent passage leads from the pressure equalizing chamber to the exterior of the enclosure. At least one membrane is in the gas vent passage. The membrane is configured to allow gas contained in the well fluid in the pressure equalizing chamber to vent and to block liquid from flowing through the gas vent passage into and out of the pressure equalizing chamber.

The well fluid port may be located below the gas vent passage. The well fluid port may also be located below the bag. The gas vent passage may have an inlet in the pressure equalizing chamber above the well fluid port.

The pressure equalizing chamber is filled with motor lubricant prior to installing the submersible pump in a well.

More particularly, the enclosure comprises a housing, a head secured to an upper end of the housing, and a base secured to a lower end of the housing. In the embodiment shown, the gas vent passage extends through the head. The well fluid port extends through the base.

In the examples shown, a membrane holding member within the housing us secured to the head. The membrane holding member has a membrane inlet port that comprises a lower part of the gas vent passage. The membrane is located within the membrane inlet port. In the embodiment shown, the membrane holding member has a threaded neck that secures to threads in the gas vent passage.

In one embodiment, the gas vent passage comprises an outlet portion extending to the exterior of the enclosure and a plurality of inlet portions joining the outlet portion and extending to the pressure equalizing chamber. One of the membranes is in each of the inlet portions.

In one embodiment, the outlet portion of the gas vent passage extends laterally, and each inlet portion extends axially, relative to a longitudinal axis of the seal section. The outlet portion has an outer end at an exterior of the head and a blind inner end. Each of the inlet portions extends from the interior side of the head to the outlet portion.

Figure 1:
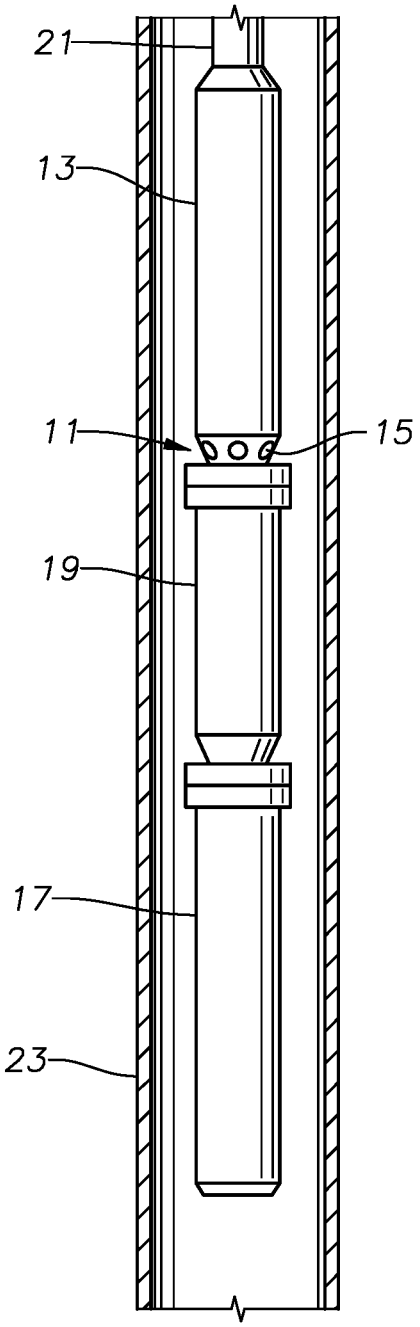
FIG. 1 is an side view of an electrical submersible pump (ESP) having a seal section in accordance with this disclosure.

While the disclosure will be described in connection with the preferred embodiments, it will be understood that it is not intended to limit the disclosure to that embodiment. On the contrary, it is intended to cover all alternatives, modifications, and equivalents, as may be included within the scope of the claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates an electrical submersible well pump (ESP) 11 of a type commonly used to lift hydrocarbon production fluids from wells. ESP 11 has a pump 13 with intake ports 15 for drawing in well fluid. Pump 13 could be made up of several similar pumps secured together in tandem by threaded fasteners or bolts, with intake ports 15 being in the lowermost pump. Intake ports 15 could also be in a separate module connected to pump 13. Further, if a rotary gas separator is employed below pump 13, intake ports 15 would be in the gas separator. Pump 13 may be of various types, such as a centrifugal pump, a progressing cavity pump or a reciprocating pump.

An electrical motor 17 is operatively mounted to and drives pump 13. Motor 17 is normally a three-phase AC motor that contains a dielectric motor lubricant for lubricating the bearings within. A seal section 19 connected to motor 17 seals around a drive shaft driven by the motor and reduces a pressure differential between the lubricant in motor 17 and the exterior well fluid. In this example, the pressure equalizing portion of seal section 19 locates between motor 17 and pump intake ports 15. Alternately, the pressure equalizing portion of seal section 19 could be located below motor 17, and other portions of seal section 19 could be above motor 17. The terms "upward", "downward", "above", "below" and the like are used only for convenience as ESP 11 may be operated in other orientations than vertical.

A string of production tubing 21 suspended within casing 23 supports ESP 11. In this example, pump 13 discharges into production tubing 21. Alternately, coiled tubing could support ESP 11, in which case pump 13 would discharge into the annulus around the coiled tubing. Motor 17 in that case would be located above pump 13. The power cable for motor 17 would be within the coiled tubing instead of alongside production tubing 21.

Figure 2:
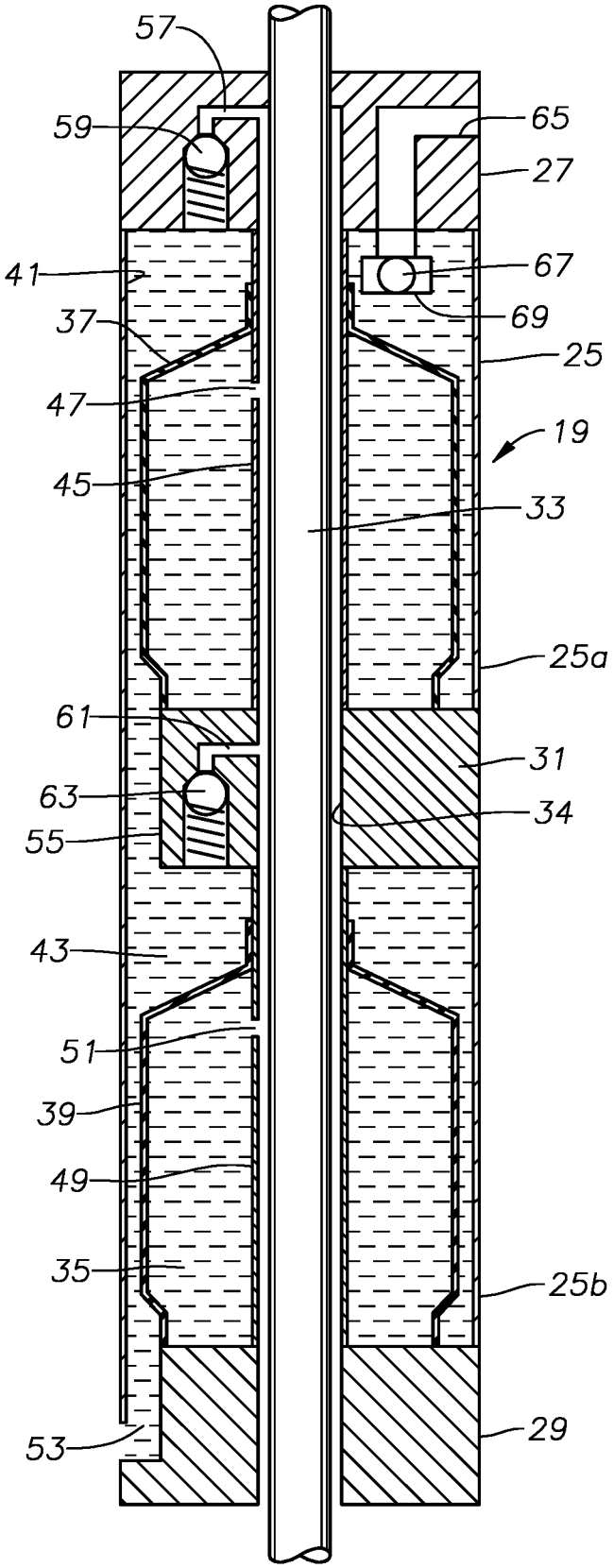
FIG. 2 is a schematic axial sectional view of the seal section of FIG. 1, shown after being filled with motor lubricant and prior to running into the well.

Referring to FIG. 2, seal section 19 has an enclosure comprising a tubular housing 25, a head or pump end 27, and a base or motor end 29, each secured by threads to housing 25. When connected into ESP 11 (FIG. 1), head 27 will be closer to pump 13 than it is to motor 17 and may be directly connected to the end of pump 13 having intake ports 15. Similarly, base 29 will be closer to motor 17 than it is to pump 13 and may be connected directly to motor 17. Alternately, base 29 could be connected to another seal section in tandem or to other pressure equalizing portions of seal section 19. In this example, housing 25 has an optional upper portion 25*a* and a separate lower portion 25*b* that are connected together by a threaded guide or intermediate connector 31.

Motor 17 (FIG. 1) rotates a drive shaft 33 with splined ends that extends through shaft passages 34 in head 27, intermediate connector 31 and base 29. Bearings (not shown) in head 27, intermediate connector 31 and base 29 radially support shaft 33. The bearings allow motor lubricant 35 from motor 17 to flow through shaft passages 34.

In this example, housing 25 has an upper bag 37 between head 27 and intermediate connector 31. Upper bag 37 comprises a flexible elastomeric bag or container. The lower end of upper bag 37 seals to intermediate connector 31, and the upper end of upper bag 37 is in a sealing arrangement with head 27. A lower bag 39, which is also an elastomeric bag, seals between intermediate connector 31 and base 29 in this example. The space surrounding the exterior of upper bag 37 within housing upper portion 25*a* comprises an upper pressure equalizing chamber 41. The space surrounding the exterior of lower bag 39 within housing lower portion 25*b* comprises a lower pressure equalizing chamber 43. Lower pressure equalizing chamber 43 and lower bag 39 could be eliminated.

An upper guide tube 45 extends coaxially through upper bag 37 around shaft 33. Upper guide tube 45 has a lower end sealed to shaft passage 34 in intermediate connector 31. Upper guide tube 45 has an upper end sealed to shaft passage 34 in head 27. The upper end of upper bag 37 seals around upper guide tube 45 at a place below head 27. Upper guide tube 45 has a larger inner diameter than an outer diameter of shaft 33, creating a shaft annulus between shaft 33 and upper guide tube 45. One or more upper guide tube ports 47 extend through the side wall of upper guide tube 45 within the interior of upper bag 37. Upper guide tube ports 47 are closer to the upper end of upper bag 37 than to the lower end of upper bag 37 in this example.

Similarly, a lower guide tube 49 extends coaxially through lower bag 39 around shaft 33. Lower guide tube 49 has a lower end sealed to shaft passage 34 in base 29 and an upper end sealed to shaft passage 34 in intermediate connector 31. The upper end of lower bag 39 seals around lower guide tube 49 at a place below intermediate connector 31. Lower guide tube 49 has a larger inner diameter than an outer diameter of shaft 33, creating a shaft annulus between shaft 33 and lower guide tube 49. One or more lower guide tube ports 51 extend through the side wall of lower guide tube 49 within the interior of lower bag 39. Lower guide tube ports 51 are closer to the upper end of lower bag 39 than to the lower end of lower bag 39 in this example.

A well fluid port 53 at the bottom of lower equalizing chamber 43 allows fluid to flow into and out lower pressure equalizing chamber 43. In this embodiment, well fluid port 53 extends through base 29. A communication passage 55 in intermediate connector 31 communicates fluid in lower pressure equalizing chamber 43 with upper pressure equalizing chamber 41. Well fluid port 53 is below lower bag 39, and communication passage 55 is below upper bag 37. Well fluid port 53 is continuously open to inward and outward flow.

Motor lubricant 35 in motor 17 (FIG. 1) is free to flow upward and downward along a motor lubricant communication path into and out of the interiors of bags 37, 39. The motor lubricant communication path passes through or around bearings in the portions of shaft passage 34 within base 29, intermediate connector 31, and head 27. The communication path includes the shaft annulus in guide tubes 45, 49 and guide tube ports 47, 51, which lead into the interiors of bag 37, 39. The communication path also allows motor lubricant 37 to pass through or around the bearing (not shown) in head 27 up to a lower side of a primary shaft seal (not shown).

An upper check valve passage 57 within head 27 leads from shaft passage 34 laterally outward, then downward through a lower end of head 27 into upper pressure equalizing chamber 41 exterior of upper bag 37. An upper check valve 59, which may be conventional, is mounted in upper check valve passage 57 near its lower end. Upper check valve 59 is schematically illustrated to comprise a ball urged upward against a seat by a spring. The upper side of upper check valve 59 is exposed to motor lubricant 35 in upper check valve passage 57 and the interior of upper bag 37. The lower side of check valve 59 is exposed to fluid in upper pressure equalizing chamber 41.

Similarly, in this example, a lower check valve passage 61 within intermediate connector 31 leads from shaft passage 34 laterally outward, then downward through a lower end of intermediate connector 31 into lower pressure equalizing chamber 43 exterior of lower bag 39. A lower check valve 63, which may be conventional, is mounted in lower check valve passage 61 near its lower end. The upper side of lower check valve 63 is exposed to motor lubricant 35 in lower check valve passage 61 and the interior of lower bag 39. The lower side of lower check valve 63 is exposed to fluid in lower pressure equalizing chamber 43.

A gas vent passage 65 at the upper end of upper pressure equalizing chamber 41 exterior of upper bag 37 leads to the exterior of seal section 19. Gas vent passage 65 is located above upper bag 37 and in head 27 in this example. Gas vent passage 65 contains a membrane 67 that will vent gas in upper pressure equalizing chamber 41 to the exterior. Membrane 67 is semi-permeable and has a pore size that will block egress of liquid in upper pressure equalizing chamber 41 through gas vent passage 65 to the exterior. Also, the pore size of membrane 67 will block ingress of well fluid on the exterior of head 27 through gas vent passage 65 into upper pressure equalizing chamber 41. One side of membrane 67 is in contact with fluid in gas vent passage 65 and the opposite side is in contact with fluid in upper pressure equalizing chamber 41. Membrane 67 may have multiple layers and be formed of a material such as polytetrafluoroethylene. Membranes suitable for membrane 67 are commercially available.

Figure 3:
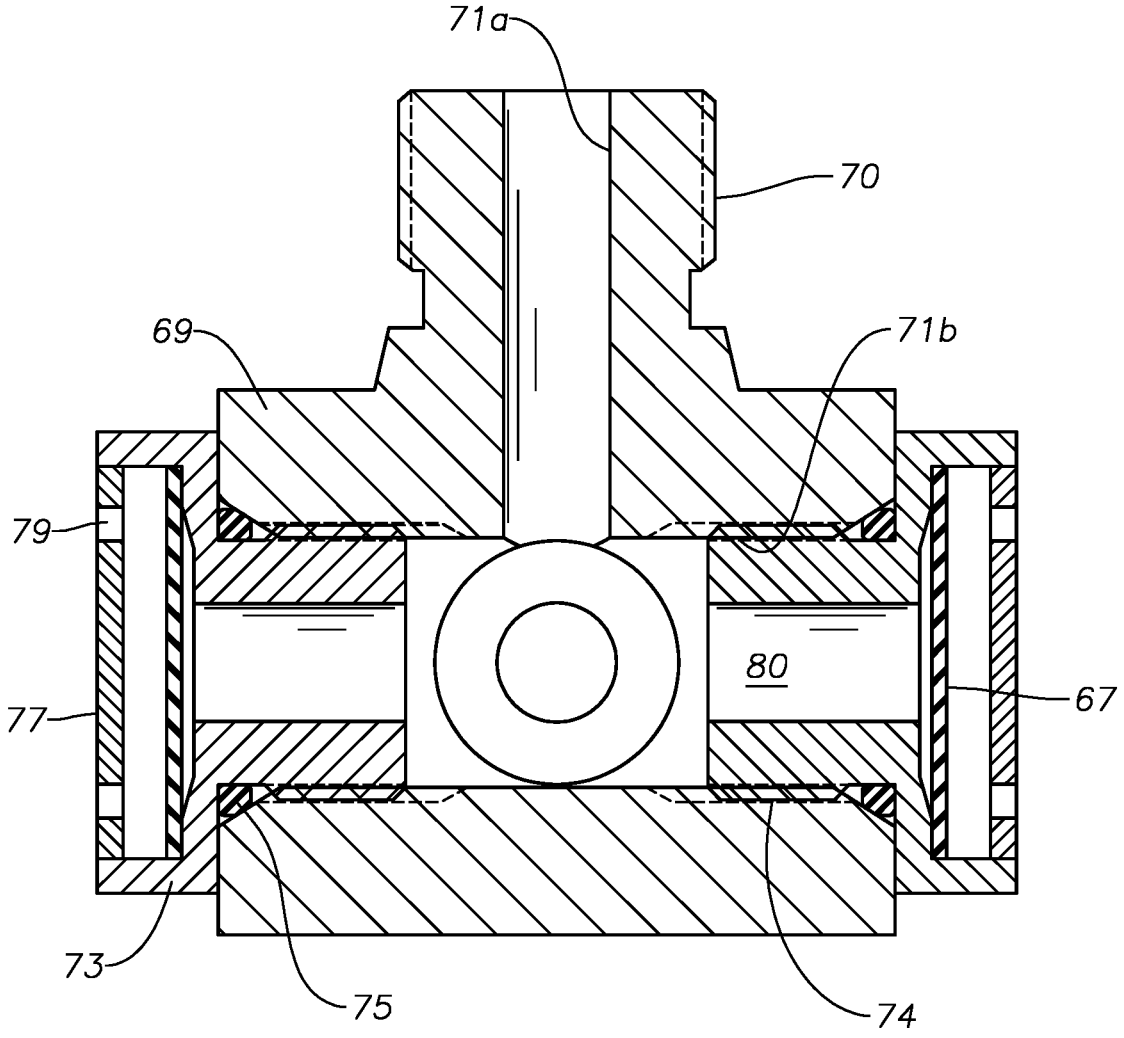
FIG. 3 is a sectional view of a manifold containing membranes for venting gas from the well fluid within the upper pressure equalizing chamber, the manifold being shown removed from the seal section.

Membrane 67 may be installed in gas vent passage 65 a number of ways. Referring to FIG. 3, in this embodiment, a manifold 69 has a threaded upper end 70 that screws into mating threads in the lower portion of gas vent passage 65 (FIG. 2). Manifold 69 is located in upper pressure equalizing chamber 41 above upper bag 37. Manifold 69 has a manifold passage 71*a* extending through manifold upper end 70 that is considered herein to be a lower extension of gas vent passage 65 (FIG. 2). Branch manifold passages 71*b* extend laterally outward from a lower end of manifold passage 71*a*. Manifold passages 71*a*, 71*b* may also be considered to be lower extensions of gas vent passage 65.

A membrane fixture or holder 73 (two shown) has a threaded neck 74 that screws into threads in each of the branch passages 71*b*. One of the membranes 67 mounts within each of the membrane holders 73. A cap 77 may secure to an outer end of membrane holder 73. Cap 77 has one or more apertures 79 to allow fluid in upper pressure equalizing chamber 41 to enter and contact membrane 67. A seal 75 seals the threaded neck 74 of each membrane holder 73 to one of the manifold branch passages 71*b*. Membrane holder 73 has an inlet 80 in threaded neck 74 that is in fluid communication with manifold passage 71*a* and gas vent passage 65. Membrane 67 is mounted transversely across inlet 80. Each membrane holder inlet 80 may be considered to be a lower part of gas vent passage 65.

Referring to FIG. 2, prior to installing ESP 11, motor 17 and seal section 19 will be filled with motor lubricant 35. The filling procedure results in motor lubricant 35 being initially within shaft passages 34 in base 29, intermediate connector 31 and in head 27. The filling procedure also fills the shaft annulus, the interiors of upper and lower bags 37, 39, and upper and lower pressure equalizing chambers 41, 43 exterior of upper and lower bags 37, 39.

As ESP 11 is lowered into casing 27, well fluid 81 in casing 23 (FIG. 1) will enter well fluid port 53 into contact with motor lubricant 35 in lower pressure equalizing chamber 43. Well fluid 81 is often primarily water and does not mix easily with motor lubricant 35, which is lighter in density. Consequently, well fluid 81 tends to remain in a lower portion of lower pressure equalizing chamber 43. Motor lubricant 35 tends to remain in the upper portion of lower pressure equalizing chamber 43 and in upper pressure equalizing chamber 41.

The hydrostatic pressure of well fluid 81 and motor lubricant 35 within lower pressure equalizing chamber 43 exerts a contracting force on lower bag 39. Because of communication passage 55, the hydrostatic pressure also exerts a contracting force on upper bag 37. The contraction of upper and lower bags 37, 39 causes motor lubricant 35 within the interiors of upper and lower bags 37, 39 to equalize and communicate that pressure to motor lubricant in motor 17 (FIG. 1). Even though the pressures on the upper and lower sides of upper and lower check valves 59, 63 are substantially the same, check valve 59, 63 will remain closed because of the bias force of their springs.

The pressure of well fluid on the exterior side of each membrane 67 should be substantially the same as the pressure on the interior side. Well fluid 81 that entered lower equalizing chamber 43 during installation may contain some gas that could migrate upward, due to lower density, through the motor lubricant 35 in lower and upper pressure equalizing chambers 43, 41 to the interior side of membrane 67. Membrane 67 is permeable to gas, thus will allow that gas to vent out through gas vent passage 65. At the low or zero differential pressures encountered by membrane 67 during operation of motor 17, membrane 67 is impermeable to liquids. The liquid impermeability prevents motor lubricant 35 in upper pressure equalizing chamber 41 from flowing out gas vent passage 65. The liquid impermeability also prevents well fluid 81 on the exterior of seal section 19 from flowing inward past membrane 67 into upper pressure equalizing chamber 41.

When ESP 11 begins to operate, motor 17 will get hotter, which causes motor lubricant 35 and upper and lower bags 37, 39 to expand in volume. Some motor lubricant 35 within pressure equalizing chambers 41, 43 may be expelled through well fluid port 53 in response to the expansion of bags 37, 39. When upper and lower bags 37, 39 are fully expanded, the pressure of motor lubricant 35 in bags 37, 39 will rise above the hydrostatic pressure of well fluid 81 in pressure equalizing chambers 41, 43. When the differential pressures on check valves 59, 63 reach a selected level, check valves 59, 63 will open, allowing motor lubricant 35 in check valve passages 57, 61 to flow downward into pressure equalizing chambers 41, 43. The differential that causes check valves 59, 63 to open may be small, only a few pounds per square inch. Also, during operation, gas from well fluid 81 migrating to the upper end of upper pressure equalizing chamber 41 will be vented through membrane 67 out gas vent passage 65.

Figure 4:
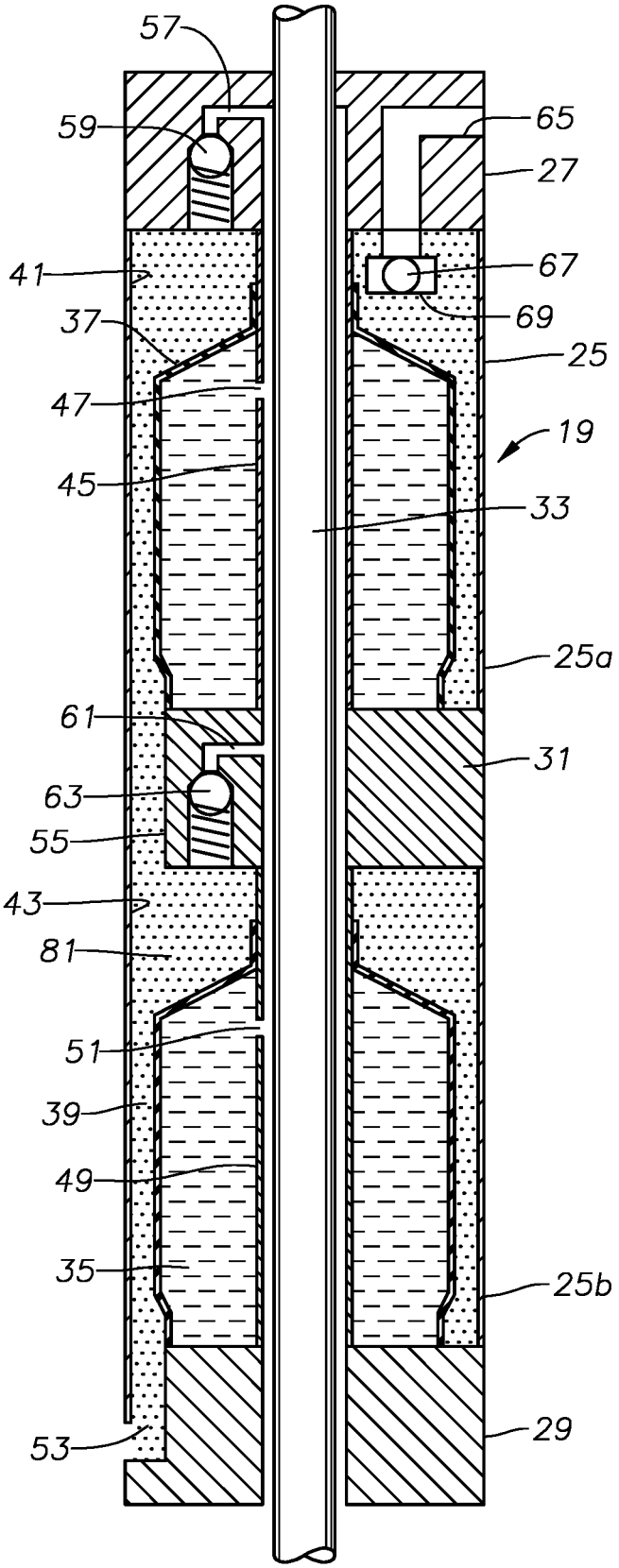
FIG. 4 is a schematic sectional view of the seal section as shown in FIG. 2, but after well fluid has filled the pressure equalizing chambers of the seal section and the bags are contracted because the motor is not operating.

When ESP 11 is shut down, motor 17 cools and motor lubricant 35 contracts. Bags 37, 39 contract in volume, as indicated in FIG. 4, causing the entry of an amount of well fluid 81 into lower pressure equalizing chamber 43 through well fluid port 53. The pressure differential on check valves 59, 63 drops to levels below the set amounts, causing check valves 59, 63 to close. Bags 37, 39 expand when motor 17 is re-started and operated long enough to heat motor lubricant 35, again expelling some of the motor lubricant 35 from lower pressure equalizing chamber 43 out well fluid port 53. Each shut down and re-start thus may result in some of the motor lubricant 35 in pressure equalizing chambers 41, 43 flowing out through well fluid port 53. The repeated contraction and expansion of bags 37, 39 over time can replace part of the motor lubricant 35 in equalizing chambers 41, 43 with well fluid 81 containing gas, as indicated in FIG. 4.

The venting of gas by membranes 67 through gas vent passage 65 prevents gas contained within well fluid 81 in pressure equalizing chambers 41, 43 from forming a gas cap in the upper portion of upper equalizing chamber 41. The avoidance of a gas cap retards gas from permeating into and through the elastomeric material of bags 37, 39. Also, avoiding a gas cap reduces rapid gas decompression, which may be harmful to bags 37, 39.

Figure 5:
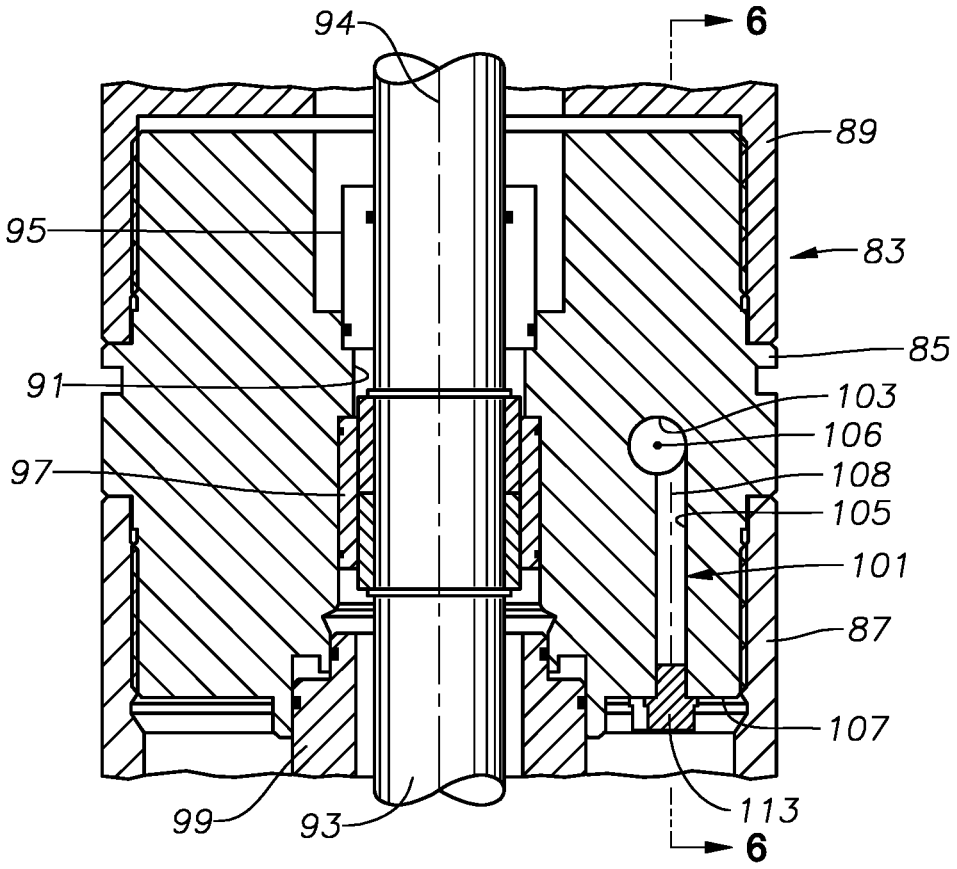
FIG. 5 is a sectional view of an upper portion of a second embodiment of the seal section of FIG. 1.

Referring to the alternate embodiment of FIG. 5, seal section 83 has a head 85 secured to a housing 87, defining an upper portion of an enclosure. The lower portions of seal section 83 may be the same as in FIG. 2. An adapter 89 secures to head 85 for connecting seal section 83 to another module of ESP 11 (FIG. 1). Head 85 has a bore 91 through which a drive shaft 93 extends along longitudinal axis 94. A mechanical face seal 95 around shaft 93 seals the upper end of bore 91. Bearings 97 support shaft 93 within bore 91. A bag retainer 99 connects an upper end of upper bag 37 (FIG. 2) to head 85. Motor lubricant 35 (FIG. 2) in the interior of upper bag 37 will be in fluid communication with bore 91.

Figure 6:
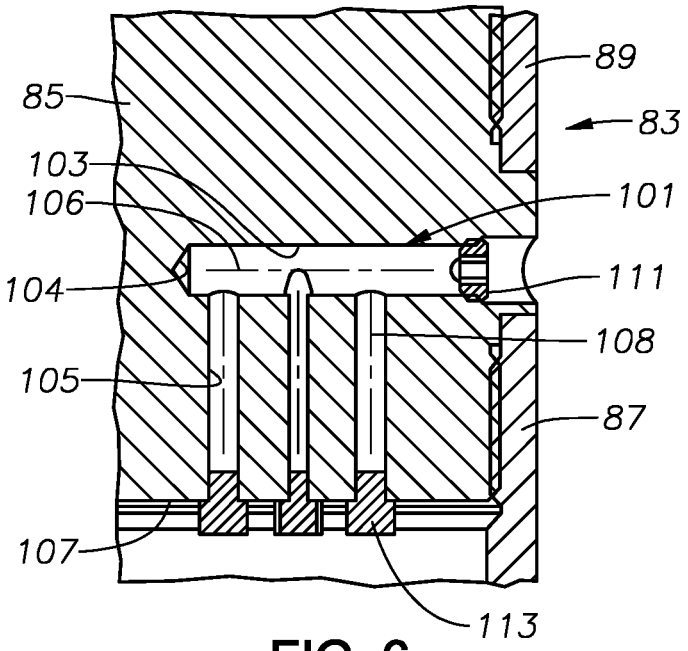
FIG. 6 is a sectional view of the seal section of FIG. 5 taken along the line 6-6 of FIG. 5.

A gas vent passage 101 extends through head 85 from the interior of housing 87 to the exterior of seal section 83. Referring also to FIG. 6, gas vent passage 101 has an outlet portion 103 that extends laterally to the exterior of head 85. Outlet portion 103 may be on a radial line of longitudinal axis 94 and has a closed or blind inner end 104 that is radially outward from bore 91. In this example, gas vent passage 101 has several inlet portions 105 that join outlet portion 103 and extend downward to interior side 107 of head 85. Three are shown, but the number could differ. Each inlet portion 105 may be parallel to axis 94, equally spaced apart, and identical to each other. The middle inlet portion 105 appears smaller in diameter in FIG. 6 than the inward and outward inlet portions 105 only because of the section plane of the drawing. The middle outlet portion 105 actually has the same diameter as the inward and outlet portions.

The upper end of each inlet passage 105 intersects outlet portion 103. In this example, axis 108 of the inward and outward inlet portions 105 intersect axis 106 of outlet portion. Axis 108 of the middle inlet portion 105 is illustrated in FIG. 5 as being slightly offset from the axis 106 of outlet portion 103, but it could alternately intersect axis 106.

A filter screen 111 may be mounted near the outer end of outlet portion 103 to filter well fluid debris from entering gas vent passage 101. A membrane holder 113, which that may be identical to membrane holder 73 (FIG. 3), has a threaded neck 74 that secures to the lower threaded end of one of the outlet portions 105. Each membrane holder 113 contains a single membrane 67 (FIG. 3) as in the first embodiment. The membranes 67 in FIG. 6 will be in parallel with each other so that if one because restricted due to debris, gas could continue to flow out through the other two.

The present disclosure described herein, therefore, is well adapted to carry out the objects and attain the ends and advantages mentioned, as well as others inherent therein. While only two embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A submersible well pump assembly, comprising:

enclosure comprising a housing, a head secured to an upper end of the housing, and a base secured to a lower end of the housing, the gas vent passage extends through the head, and the well fluid port extends through the base;

expandable and contractible bag within the enclosure, defining a pressure equalizing chamber in the enclosure surrounding an exterior of the bag;

a motor lubricant communication path for communicating motor lubricant from a motor of the assembly to an interior of the bag;

a well fluid port for admitting well fluid on an exterior of the enclosure into the pressure equalizing chamber;

a gas vent passage leading from the pressure equalizing chamber to the exterior of the enclosure; and at least one m brane in the gas vent passage, the membrane being configured to allow gas contained in the well fluid in the pressure equalizing chamber to vent and to block liquid from flowing through the gas vent passage into and out of the pressure equalizing chamber.

2. The assembly according to claim 1, wherein:

the well fluid port is located below the gas vent passage.

3. The assembly according to claim 1, wherein:

the well fluid port is located below the bag; and the gas vent passage has an inlet in the pressure equalizing chamber above the well fluid port.

4. The assembly according to claim 1, wherein:

the pressure equalizing chamber is filled with motor lubricant prior to installing the submersible pump in a well.

5. The assembly according to claim 1, wherein the assembly further comprises:

a membrane holding member within the housing, the membrane holding member being secured to the head and having a membrane inlet port in fluid communication with the gas vent passage;

and wherein the at least one membrane is located within the membrane inlet port.

6. The assembly according to claim 5, wherein the membrane holding member has a threaded neck that secures to threads in the gas vent passage.

7. The assembly according to claim 1, wherein:

the gas vent passage comprises an outlet portion extending to the exterior of the enclosure and a plurality of inlet portions joining the outlet portion and extending to the pressure equalizing chamber; and the at least one membrane comprises a plurality of the membranes, each in one of the inlet portions.

8. The assembly according to claim 1, wherein: the housing has a longitudinal axis and an interior side facing the base;

the gas vent passage comprises a laterally extending outlet portion and a plurality of axially extending inlet portions, relative to the longitudinal axis, the outlet portion having an outer end at an exterior of the head and a blind inner end, each of the inlet portions extending from the interior side of the head to the outlet portion; the at least one membrane comprises a plurality of the membranes; and the assembly further comprises: a plurality of membrane holders, each containing one of the membranes and secured to one of the inlet portions.

9. A submersible well pump assembly, comprising:

a pump;

a motor;

a seal section between the motor and the pump for reducing a pressure differential between motor lubricant in the motor and well fluid on an exterior of the motor; the seal section comprising:

a housing having a longitudinal axis, the housing having a head on an upper end and a base on a lower end;

an expandable and contractible bag within the housing, defining a pressure equalizing chamber in the housing that surrounds the bag, the pressure equalizing chamber being filled with motor lubricant;

a motor lubricant communication path that communicates motor lubricant from the motor to an interior of the bag;

a well fluid port in the housing leading from an exterior of the housing to the pressure equalizing chamber;

a gas vent passage in the head leading from the pressure equalizing chamber to an exterior of the housing; and a plurality of membranes in parallel with each other in the housing and configured to allow gas venting through the membranes from the pressure equalizing chamber, to block liquid flow from the pressure equalizing chamber through the membranes out of the gas vent passage, and to block liquid flow from the gas vent passage through the membranes into the pressure equalizing chamber.

10. The assembly according to claim 9, wherein the well fluid ports are in the base of the housing.

11. The assembly according to claim 9, wherein:

the gas vent passage comprises a laterally extending outlet portion and a plurality of axially extending inlet portions, relative to the longitudinal axis, the outlet portion having a blind inner end and an outer end at an exterior of the head, each of the inlet portions extending from an interior side of the head to the outlet portion;

the at least one membrane comprises a plurality of the membranes; and the assembly further comprises:

a plurality of membrane holders, each containing one of the membranes and secured to one of the inlet portions.

12. The assembly according to claim 9, wherein:

the gas vent passage has a threaded inlet leading into the pressure equalizing chamber;

and the assembly further comprises:

a membrane holding member, the membrane holding member having a threaded neck secured to the threaded inlet and having an inlet port leading from the threaded neck to the pressure equalizing chamber; and wherein the membrane is located within the inlet port.

13. The assembly according to claim 9, wherein the well fluid port is continuously open.

14. The assembly according to claim 9, wherein the gas vent passage and the membrane are continuously open to venting of gas from the pressure equalizing chamber.

15. A method of reducing a pressure differential between motor lubricant in a motor of an electrical submersible well pump assembly (ESP) and well fluid on an exterior of the well pump assembly, the ESP comprising:

an enclosure;

an expandable and contractible bag within the enclosure, defining a pressure equalizing chamber in the enclosure surrounding an exterior of the bag; and a well fluid port leading from the exterior of the enclosure to the pressure equalizing chamber;

the method comprising:

forming a gas vent passage in the enclosure leading from the pressure equalizing chamber to the exterior of the enclosure;

mounting at least one membrane in the gas vent passage;

prior to installing the ESP in a well, filling the pressure equalizing chamber with motor lubricant on the exterior of the bag and filling an interior of the bag with motor lubricant;

communicating motor lubricant from the motor to an interior of the bag;

installing the ESP in the well, causing well fluid containing a well fluid liquid and a well fluid gas to enter the well fluid port into contact with the motor lubricant in the pressure equalizing chamber, and allowing the gas to migrate upward in the pressure equalizing chamber through the motor lubricant;

venting the gas in the pressure equalizing chamber through the membrane and out the gas vent passage;

with the membrane, blocking the motor lubricant in the pressure equalizing chamber from flowing out the gas vent passage; and with the membrane, blocking well fluid on the exterior of the pressure equalizing chamber from flowing through the gas vent passage into the pressure equalizing chamber.

16. The method according to claim 15, wherein:

forming the gas vent passage comprises placing an inlet of the gas vent passage at an upper end of the pressure equalizing chamber.

17. The method according to claim 15, wherein:

the well fluid port is at a lower end of the pressure equalizing chamber.

18. The method according to claim 15, wherein:

mounting at least one membrane comprises mounting a plurality of membranes in parallel with each other.

* * * * *